US008726528B2

(12) United States Patent
Lyles

(10) Patent No.: US 8,726,528 B2
(45) Date of Patent: May 20, 2014

(54) ELECTRIC HEAD SHAVER

(75) Inventor: John Lyles, Cherry Hill, NJ (US)

(73) Assignee: Skull Shaver, LLC, Mount Holly, NJ (US)

( * ) Notice: Subject to any disclaimer, the term of this patent is extended or adjusted under 35 U.S.C. 154(b) by 310 days.

(21) Appl. No.: 13/136,692

(22) Filed: Aug. 8, 2011

(65) Prior Publication Data

US 2013/0212885 A1 Aug. 22, 2013

(51) Int. Cl.
*B26B 27/00* (2006.01)
*B26B 21/00* (2006.01)

(52) U.S. Cl.
USPC ..... 30/526; 30/298

(58) Field of Classification Search
USPC ..... 30/526–529, 539, 43.6–46, 298; D28/50
See application file for complete search history.

(56) References Cited

U.S. PATENT DOCUMENTS 2,279,682 A * 4/1942 Jackson ..... 30/43.6
2,720,696 A * 10/1955 Wadsworth ..... 30/41.5
4,709,475 A * 12/1987 Phung ..... 30/31
5,520,616 A 5/1996 Hofmeister
6,018,877 A * 2/2000 Greene ..... 30/526
6,550,148 B2 * 4/2003 Cecil ..... 30/526
D601,301 S * 9/2009 Bao ..... D28/50
2005/0246906 A1 * 11/2005 Greene ..... 30/527
2008/0072430 A1 * 3/2008 Cafaro et al. ..... 30/45
2008/0092393 A1 * 4/2008 Van Der Meer ..... 30/43.6
2009/0025234 A1 * 1/2009 Carlucci ..... 30/527
2011/0030220 A1 * 2/2011 Shimizu ..... 30/43.6

FOREIGN PATENT DOCUMENTS

DE 3320290 A1 * 12/1984

* cited by examiner

*Primary Examiner* — Ghassem Alie
*Assistant Examiner* — Bharat C Patel
(74) *Attorney, Agent, or Firm* — Norman E. Lehrer

(57) ABSTRACT

An electric shaver includes a housing and a cutter head extending down from the housing. The housing contains the motor and is shaped to provide a grip that includes a pair of concave surfaces on the sides. An additional pair of concave surfaces is formed in the undersurface of the housing that accommodates the backs of the user's fingers when the cutter head is held for shaving.

3 Claims, 6 Drawing Sheets

ELECTRIC HEAD SHAVER

BACKGROUND OF THE INVENTION

The present invention is directed toward electric shavers and, more particularly, toward electric shavers for shaving hair on curved parts of the body, specifically, the head.

Electric shavers generally include a hand-held housing that contains motor and power supply-related components that drive one or more cutters or cutting heads. The housing also provides a form that fits the user's hand sufficiently as a grip so as to allow the user to manipulate the shaver, especially when reaching upward to shave the head. Various types of cutters are well known in the art. In general, the cutter comprises an outer, stationary, apertured surface and an inner array of reciprocating or rotating blades that operate in a shearing engagement with the outer apertured surface. The motor is mechanically coupled to the cutter and provides motion to the array of blades. Hairs that extend through the apertures in the outer surface are sheared by the inner array of blades.

The present disclosure relates to such electric shavers and particularly to compact electric shavers of a particular structure, specifically to a grip configuration and housing form that is appropriately suited for shaving curved portions of the body, especially the head.

SUMMARY OF THE INVENTION

The present disclosure relates to features that are particular to the shaving of the head, though not in a limiting manner. As understood by one skilled in the art, the principles of an electric shaver are not restricted to the shaving of a specific part of the body, and may apply to any skin surface. Electric shavers designed more particularly for shaving the face have a grip portion that is configured, predominantly, to be held in such a manner so as to orient the grip below the cutting surface. Shaving the head, however, requires the shaver to be held in such a manner so as to orient the grip above the cutting surface. Note, for example, Published Application No. 2009/0025234 to Carlucci and, particularly, FIGS. 7 and 8 thereof.

An example embodiment relates in general to an electric shaver comprising a housing that provides a container for the motor and power source components and further provides a form, also referred to as a grip, that fits the hand in a comfortable manner when the shaver is oriented with the grip above the cutter surface. In other words, in this orientation the cutter faces downward so as to meet the skin surface of the scalp, and the grip is above the cutter. The cutter surface may comprise flexible members that allow the cutter surface to meet the complex curvilinear surface of the head. The grip portion of the housing comprises a pair of substantially concave surfaces each comprising a central axis that is parallel to the cutter surface and, therefore, tangent to the curved surface being shaved.

When the shaver of the present invention is oriented in the above manner, it is possible to either grip the shaver with two fingers as between the thumb and index finger, or between the index and middle fingers, while resting the remainder of the hand against the skin. This helps the user properly orient and place the cutting surface of the shaver against the skin while being able to feel whether the skin has been sufficiently shaved.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
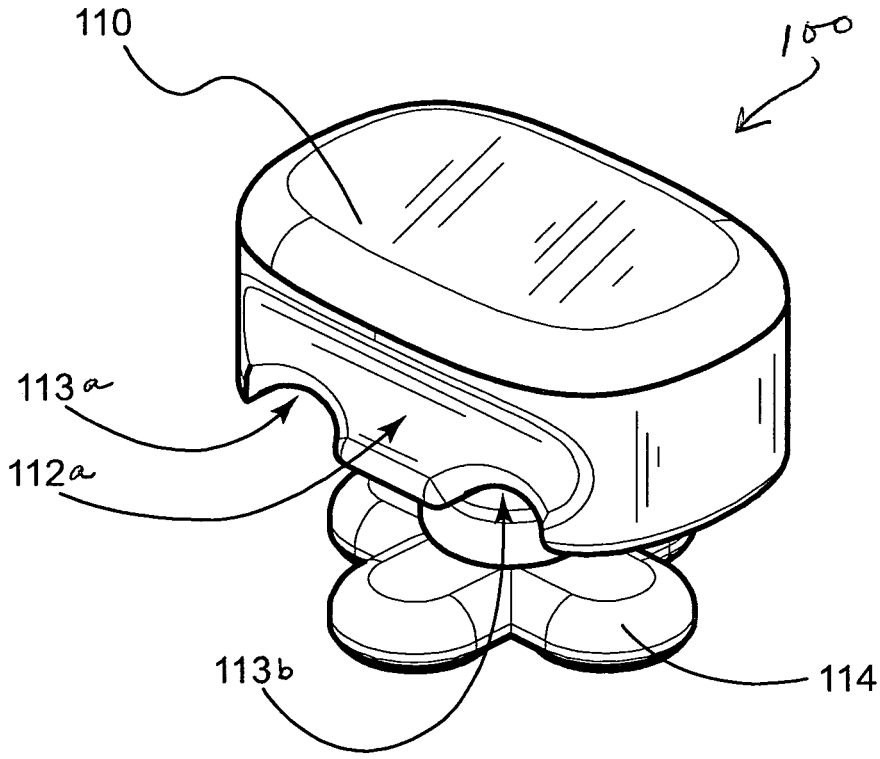
FIG. 1 is a front top perspective view of an electric head razor of the invention.

A more complete understanding of the components, processes, and apparatuses disclosed herein can be obtained by reference to the accompanying figures. These figures are intended to demonstrate the present disclosure and are not intended to show relative sizes and dimensions or to limit the scope of the exemplary embodiments.

Although specific terms are used in the following description, these terms are intended to refer only to particular structures in the drawings and are not intended to limit the scope of the present disclosure. It is to be understood that like numeric designations refer to components of like function.

The term "about" when used with a quantity includes the stated value and also has the meaning dictated by the context. For example, it includes at least the degree of error associated with the measurement of the particular quantity. When used in the context of a range, the term "about" should also be considered as disclosing the range defined by the absolute values of the two endpoints. For example, the range "from about 2 to about 4" also discloses the range "from 2 to 4."

In one embodiment, the present disclosure relates to a shaver that comprises a gripping means and a cutting means, configured in such a manner that allows the shaver to be oriented with the grip portion above the cutter portion, thus making it anatomically convenient to hold the shaver against the top and sides of the head.

Referring now to the drawings in detail wherein like reference numerals have been used throughout the various figures to designate like elements, there is shown in FIGS. 1-6 an electric head razor constructed in accordance with the principles of the present invention and designated generally as 100.

Figure 2:
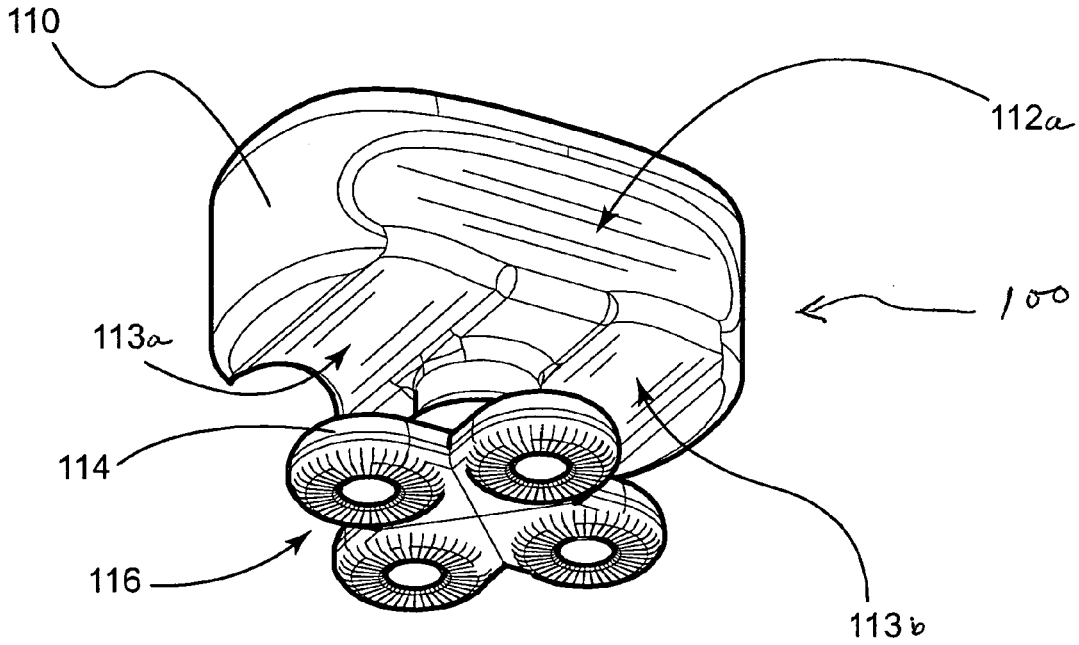
FIG. 2 is a bottom perspective view of the razor of FIG. 1.
Figure 3:
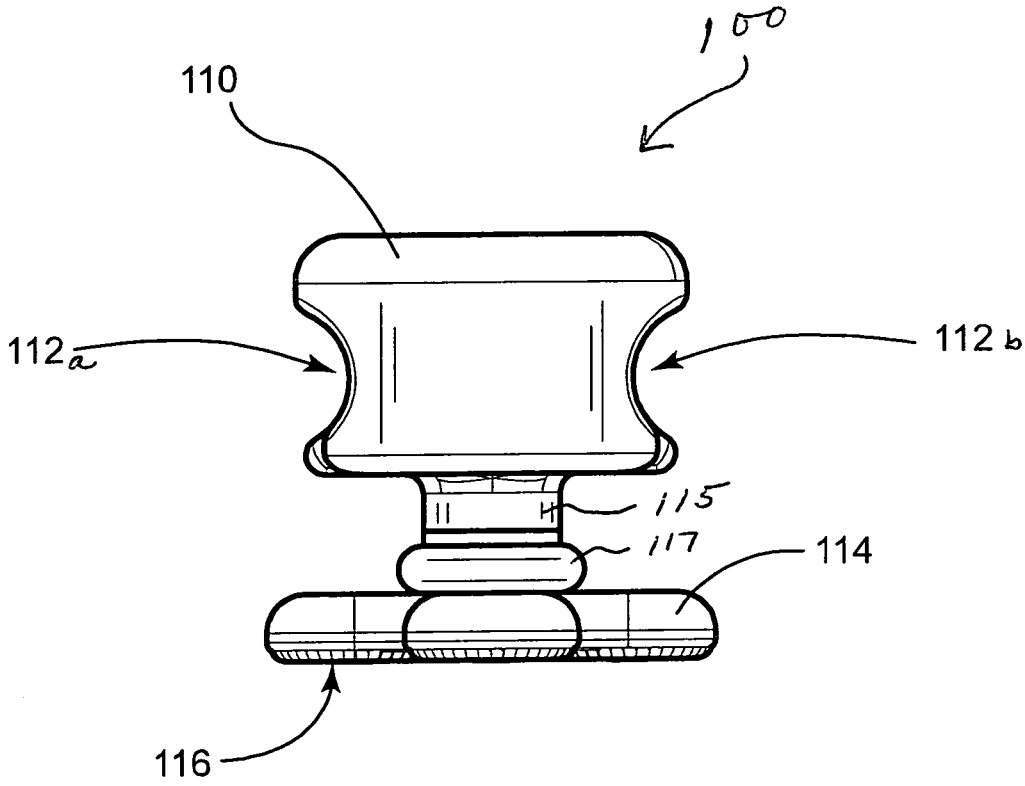
FIG. 3 is an end elevational view thereof.
Figure 4:
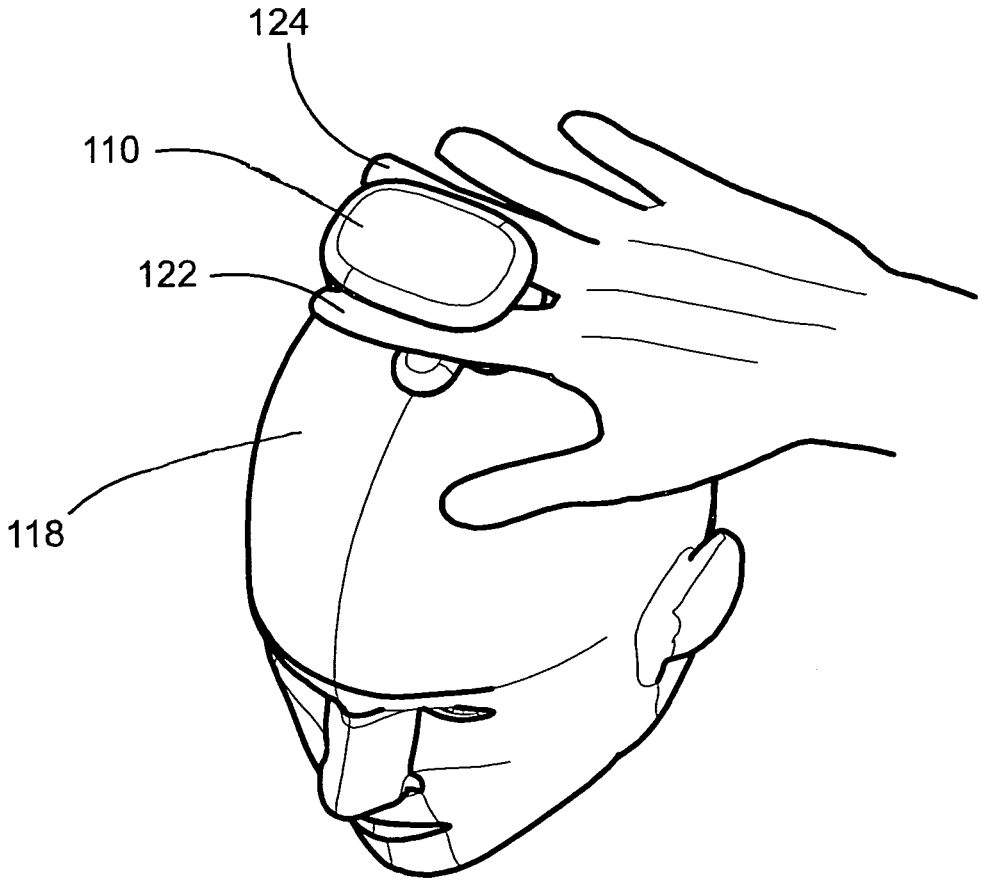
FIG. 4 is a top perspective view of the electric head razor illustrating one way of holding the same to shave one's head.
Figure 5:
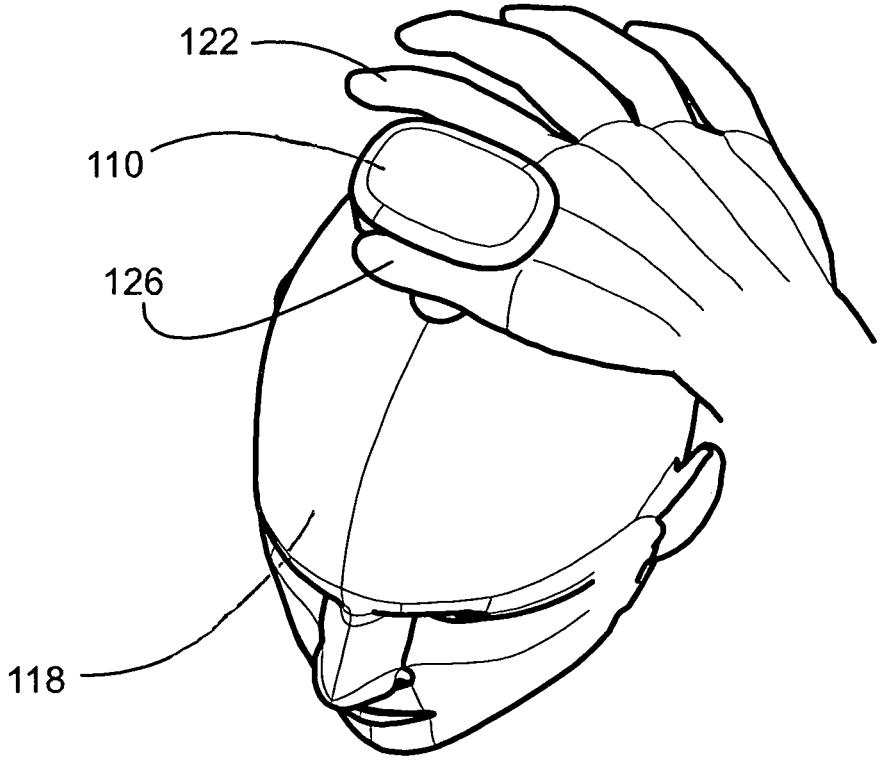
FIG. 5 is a top perspective view of the electric head razor illustrating a second way of holding the same to shave one's head.
Figure 6:
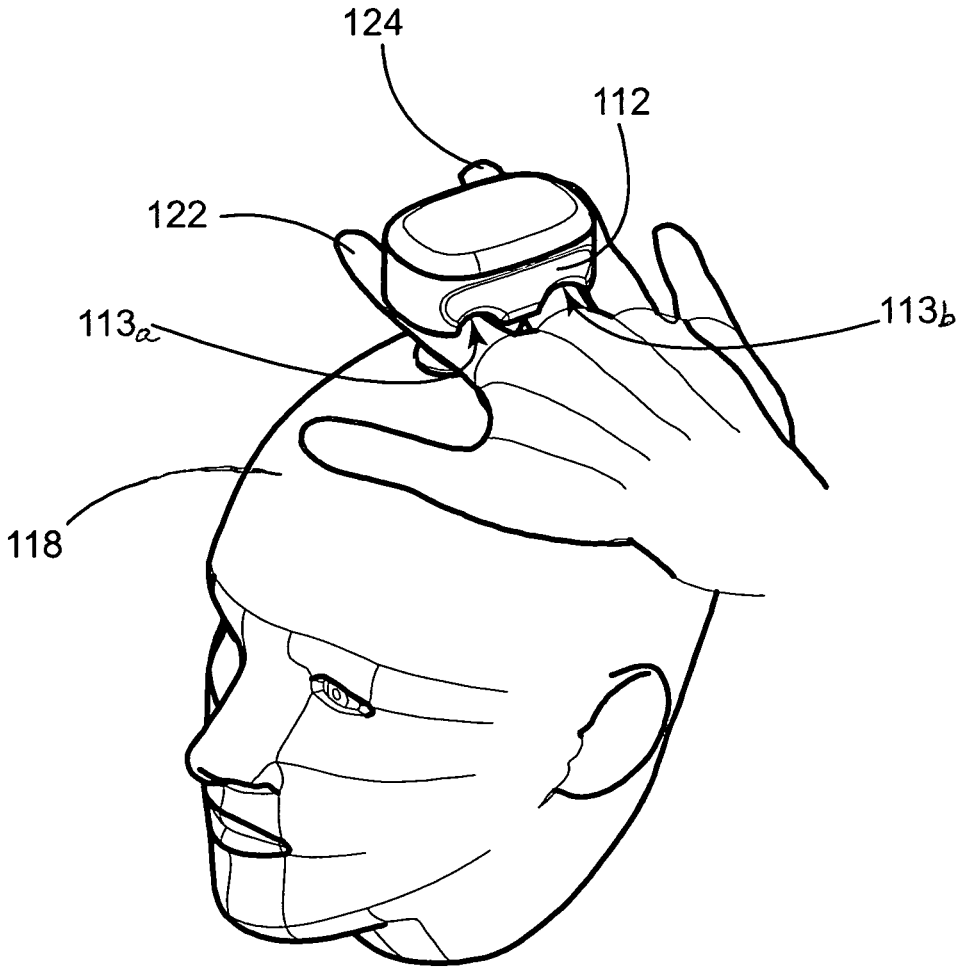
FIG. 6 is a top perspective view of the electric head razor illustrating a third way of holding the same.

As pointed out above, FIG. 1 is a top perspective view of one exemplary embodiment of an electric shaver of the present invention. FIG. 2 is a bottom perspective view of the shaver of FIG. 1. FIG. 3 is an end view of the shaver of FIG. 1. FIG. 4 is a front, perspective view of the shaver of FIG. 1 depicting the shaver held between the index and middle finger with the cutter surface held against the top of the head. FIG. 5 is a front perspective view of the shaver of FIG. 1 depicting the shaver held between the thumb and index finger and held with the cutter surface against the top of the head. FIG. 6 is a front perspective view of the shaver of FIG. 1 depicting an alternate way of holding the same between the index and middle fingers with the cutter surface against the top of the head.

As shown in FIG. 1 through FIG. 3, the shaver 100 comprises an upper portion 110 that provides a substantially rectangularly shaped housing for a power source and motor related components, and a cutter head 114 that further comprises at least one rotating or oscillating cutter or array of cutters 116. The connection between the motor and the cutter head passes through the central hub 115 which may have an enlarged lower portion 117. The cutter head 114 may be comprised of a flexible or semi-flexible material such as castable elastomer allowing the cutter heads to flex when meeting the curved surface of the head. The motor (not shown) is mechanically coupled to the cutters 116 in a known manner.

The motor, power supply and other related components along with the rotating or oscillating cutters are not, per se, part of the present inventive concept. They are all individually common and well known in the art. Accordingly, detailed descriptions of the same are not believed to be necessary. As is also known, and as can be seen, the rotating or oscillating cutters meet rounded as well as flat surfaces, appropriately for shaving.

The housing 110 further comprises a particular form that provides a gripping means, and fits the hand in a comfortable manner, especially when the shaver is held in an orientation wherein the housing is above the cutter. The gripping means includes a pair of elongated recesses in the form of parallel concave surfaces 112*a* and 112*b* formed on either side of the housing 110. The concave surfaces are parallel to the plane defined by the cutting surface of the cutters 116. A second pair of elongated recesses in the form of concave surfaces 113*a* and 113*b* are formed in the under surface of the housing above the cutters 116. The second pair of concave surfaces 113*a* and 113*b* are arranged to be perpendicular to the first pair of concave surfaces 112*a* and 112*b* and also parallel to the plane defined by the cutting surface of the cutters 116.

Referring to FIG. 3 and FIG. 4, concave surfaces 112*a* and 112*b* (FIG. 3) are configured to allow the shaver 100 to be gripped in the manner illustrated in FIG. 4, wherein the shaver is gripped between the index finger 122 and middle finger 124, and held against the scalp 118 with the user's palm facing downwardly. The remainder of the hand may rest against the scalp in a manner that allows the user to feel the surface of the scalp, which helps the user guide the shaver cutting surface as well as inspect the quality of the shave by feel.

Referring to FIG. 3 and FIG. 5, concave surfaces 112*a* and 112*b* (FIG. 3) are configured to allow the razor 100 to be gripped as illustrated in FIG. 5, in which the shaver is gripped between the thumb 126 and index finger 122, and held against the skull 118. The remainder of the hand may rest against the scalp as in the aforementioned gripping manner.

Referring to FIG. 6, concave surfaces 113*a* and 113*b* are configured to allow the razor 100 to be gripped as illustrated in FIG. 6, in which the shaver is gripped between the index finger 122 and middle finger 124 with the tops of the fingers lying within the concave surfaces or recesses 113*a* and 113*b*, and held against the skull 118. In this position, the inside surfaces of the fingers 122 and 124 grip either side of the central hub 115 and the lower part of the fingers press downwardly, at least in part, on the enlarged lower portion 117 of the hub 115. The remainder of the hand may rest against the scalp as in the aforementioned gripping manner.

The present disclosure has been described with reference to an exemplary embodiment. Obviously, modifications and alterations will occur to others upon reading and understanding the preceding detailed description. It is intended that the present disclosure be construed as including all such modifications and alterations insofar as they come within the scope of the appended claims or the equivalents thereof.

I claim:

1. An electric shaver comprising:

a housing for containing an electrical source and drive-related components, said housing having a length and a width, and including two substantially opposed and substantially parallel sides along said length, said housing further including a bottom;

a cutter mechanism located beneath said bottom of said housing and spaced therefrom;

a central hub extending from said bottom of said housing to said cutter mechanism and connecting said cutter mechanism to said housing;

said cutter mechanism including a cutting surface defining a plane;

a first pair of elongated recesses formed on said sides of said housing, said first pair of elongated recesses being substantially parallel to each other and lying in a plane that is spaced apart from but parallel to the plane of said cutting surface, and a second set of elongated spaced apart recesses formed in said bottom of said housing along said width entirely, and extending upwardly into said bottom, said recesses of said second set being located on opposite sides of said hub and extending perpendicular to said first pair of recesses.

2. The electric shaver as claimed in claim 1 wherein each of said recesses is defined by a concave surface adapted to accommodate a portion of a user's fingers therein.

3. An electric shaver comprising:

a housing for containing an electrical source and drive-related components, said housing having a length and a width, and including two substantially opposed and substantially parallel sides along said length, said housing further including a bottom surface, and a bottom surface, said bottom surface defining a first plane;

a cutter mechanism located beneath said bottom surface of said housing and spaced therefrom;

a central hub extending from said bottom surface of said housing to said cutter mechanism and connecting said cutter mechanism to said housing;

said cutter mechanism including a cutting surface defining a second plane, said second plane being parallel to but spaced from said first plane;

a first pair of elongated recesses formed on said sides of said housing, said first pair of elongated recesses being substantially parallel to each other and lying in a third plane that is spaced apart from but parallel to said first and second planes;

a second set of elongated spaced apart recesses formed in said bottom surface of said housing along said width entirely, and extending upwardly into said bottom surface, said recesses of said second set being located on opposite sides of said hub and extending perpendicular to said first pair of recesses, and wherein each of said recesses is defined by a concave surface adapted to accommodate a portion of a user's fingers therein.

* * * * *